US006067882A

United States Patent [19]

Hillinger

[11] Patent Number: 6,067,882

[45] Date of Patent: May 30, 2000

[54] RATCHET CONTROL COVER

[75] Inventor: George Hillinger, Los Angeles, Calif.

[73] Assignee: Alltrade Inc., Long Beach, Calif.

[21] Appl. No.: 09/371,154

[22] Filed: Aug. 9, 1999

[51] Int. Cl.[7] ..... B25B 13/46

[52] U.S. Cl. ..... 81/63.1; 81/63; 81/63.2; 81/62

[58] Field of Search ..... 81/63.1, 62, 63, 81/63.2

[56] References Cited

U.S. PATENT DOCUMENTS

| | | | |
|---|---|---|---|
| 2,744,432 | 5/1956 | Rueb | 81/62 |
| 3,823,625 | 7/1974 | Myers | 81/59.1 |
| 5,012,705 | 5/1991 | Chow | 81/63 |
| 5,056,635 | 10/1991 | Grimsley | 192/43.2 |
| 5,603,393 | 2/1997 | Ghode et al. | 192/43.2 |

FOREIGN PATENT DOCUMENTS

| | | | |
|---|---|---|---|
| 2354-639 | 10/1973 | Germany | 81/63 |

*Primary Examiner*—James G. Smith
*Assistant Examiner*—Hadi Shakeri
*Attorney, Agent, or Firm*—Robert R. Thornton

[57] ABSTRACT

An improvement in a ratcheting driver of the type having a handle, a driver head connected to the handle, a driver stem, ratchet means contained in the head and including ratcheting direction selector means disposed on the head in axial alignment with and remote from the driver stem and operable to lock the driver stem against rotation in a direction which is preselected by the user by the limited rotation of the ratcheting direction selector means in a predetermined direction, consisting of a ratcheting direction control wheel disposed on the head in axial alignment with and remote from the driver stem and fixed to the ratchet means, and a control wheel cover disposed over the control wheel so as to be separated from the head thereby and locked to the head.

4 Claims, 3 Drawing Sheets

RATCHET CONTROL COVER

BACKGROUND OF THE INVENTION

The present invention relates to an improvement in a ratcheting wrench type driver, and, more particularly, to a cover plate to cover the ratchet direction control element in a wrench of the type in which the ratchet direction control element is mounted in axial alignment with the driver stem and is rotated to select the direction in which torque is applied to a driven element by the driver stem.

SUMMARY OF THE INVENTION

An improvement in a ratcheting driver of the type having a handle, a driver head connected to the handle, a driver stem, ratchet means contained in the head and including ratcheting direction selector means disposed on the head in axial alignment with and remote from the driver stem and operable to lock the driver stem against rotation in a direction which is preselected by the user by the limited rotation of the ratcheting direction selector means in a predetermined direction, comprising a ratcheting direction control wheel disposed on the head in axial alignment with and remote from the driver stem and fixed to the ratchet means, a control wheel cover disposed over the control wheel so as to be separated from the head thereby, the control wheel cover having at least one cut out formed in its perimeter so as to permit manual access to the control wheel and a tail element formed on the cover so as to extend toward the handle, an aperture formed in the tail element, a complementary aperture formed in the head, and a fastener extending through the apertures in the head and tail element so as to lock the cover to the head.

BRIEF DESCRIPTION OF THE DRAWING

The present invention may be more readily understood by referring to the accompanying drawing, in which.

DETAILED DESCRIPTION OF THE PREFERRED EMBODIMENT

Figures 1, 2:
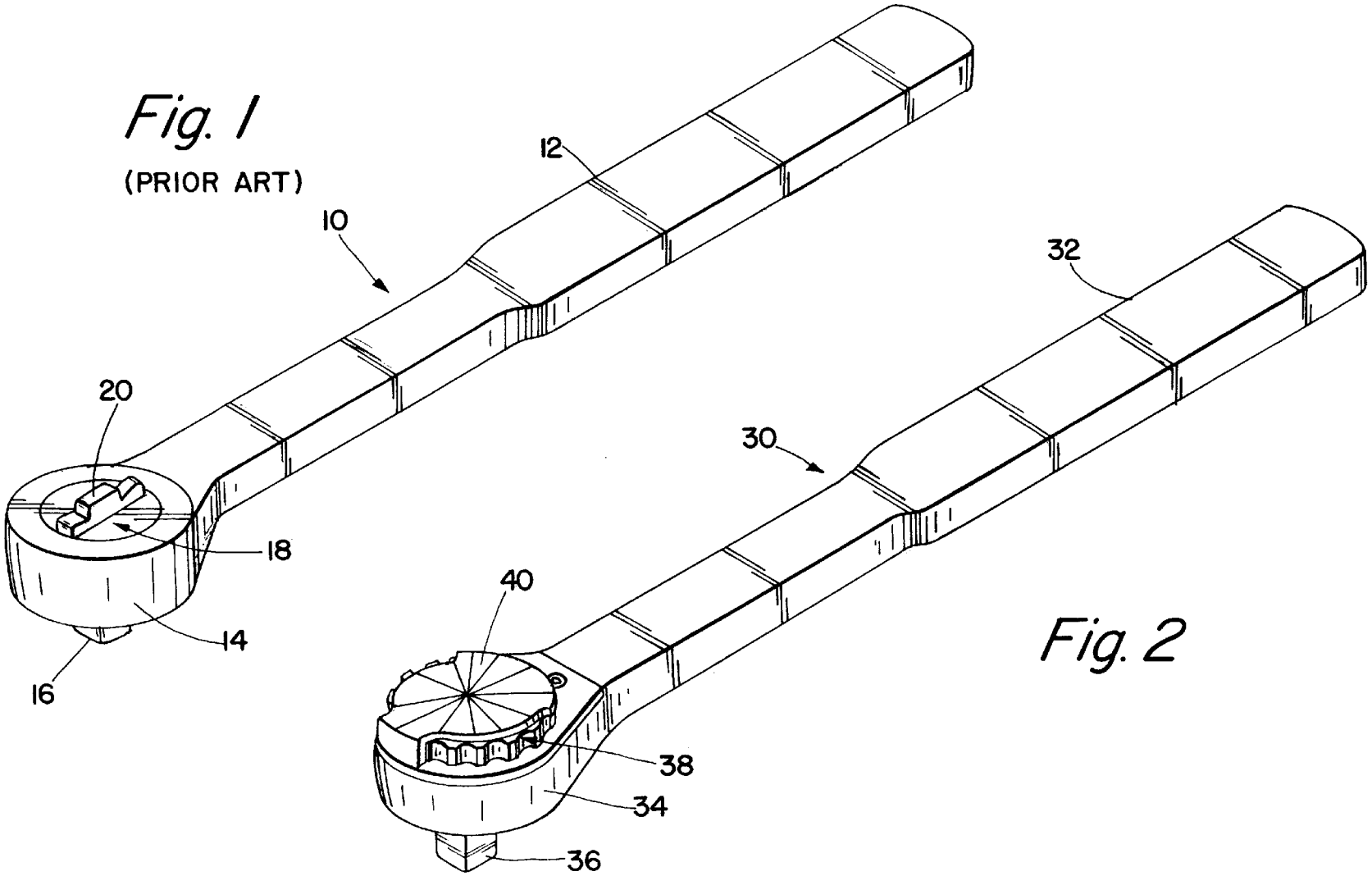
Fig. 1 (PRIOR ART)
FIG. 1 is a view, in perspective, of a typical prior art ratcheting driver to which the present invention is applicable.
FIG. 2 is a view, in perspective, of a ratcheting driver according to the present invention.

Referring first to FIG. 1, there is shown, in perspective, a ratcheting driver 10 of the type which is typical of the prior art. The driver 10 has a handle 12 and a head 14. The driver has a ratcheting mechanism (not shown) contained within the head 14 and connected to a driver stem 16, which is operable in well known fashion to enable a user to apply torque to a driven element through the driver stem 16. The direction in which torque can be applied to the driven element is controlled by a torque direction control element 18, which includes a selector knob 20, which is rotatable through an arc to select whether clockwise torque or counterclockwise torque is applied to the driven element, the structural elements for the accomplishment of which having long been well known in the art and which form no part of the present invention.

Referring now to FIG. 2, a ratcheting driver 30 according to the present invention is shown in perspective. The driver 30 has a handle 32 is shown for purposes of illustration as similar to the handle 12, but which may be of any conventional configuration. The driver has a head 34, which is generally similar to the head 14, and a drive stem 36, which is generally similar to the drive stem 16. The configurations of the head 34 and drive stem 36 are shown for illustrative purposes only, and not by way of limitation. A torque direction control element 38 is shown in FIG. 2 as in the configuration of a wheel, which is the preferred configuration of this element of the present invention. The torque direction control wheel 38 functions in the same manner as the torque direction selector 20 of the driver 10 to select the direction in which torque may be applied to the drive stem 36. The torque direction control wheel 38 is covered by a torque direction control wheel cover plate 40.

Figure 3:
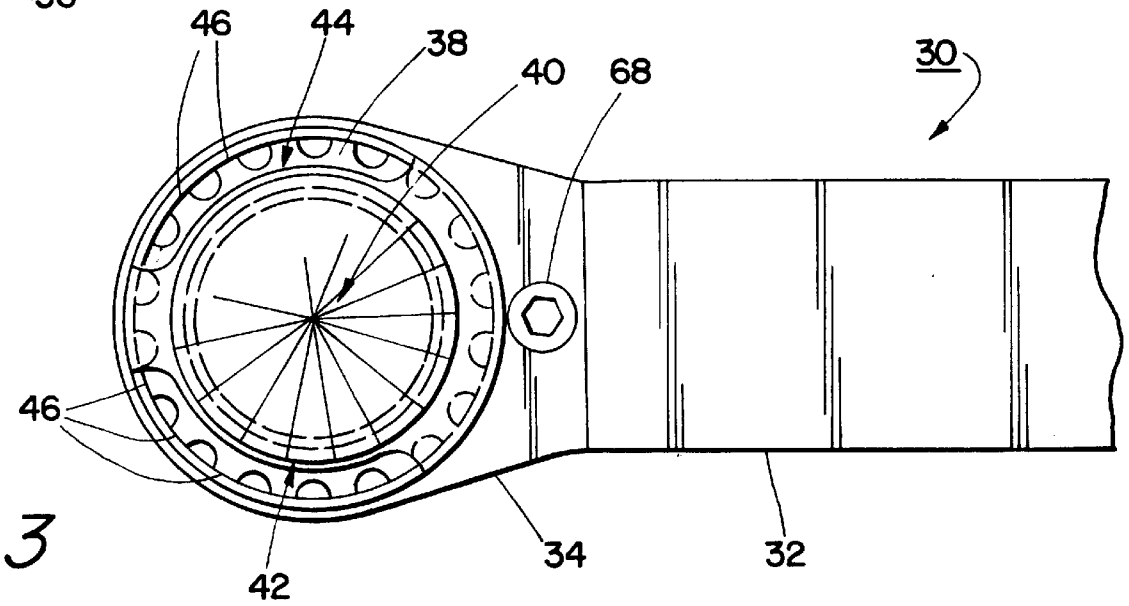
FIG. 3 is a partial plan view of the driver of FIG. 2.

Referring now to FIG. 3, which is a plan view, partially broken away, of the driver 30, the cover plate 40 is seen to have a pair of recesses 42, 44 formed on its perimeter. The torque direction control wheel 38 can be manually accessed through these recesses 42, 44, see also FIG. 6), so as to control the direction in which torque may be applied by the drive stem 36. In the preferred embodiment of the torque direction control wheel 38 (shown in FIGS. 3 and 7) has a series of peripheral teeth 46 formed thereon to facilitate the rotation by the user of the wheel 38 to select to torque application direction.

Figure 4:
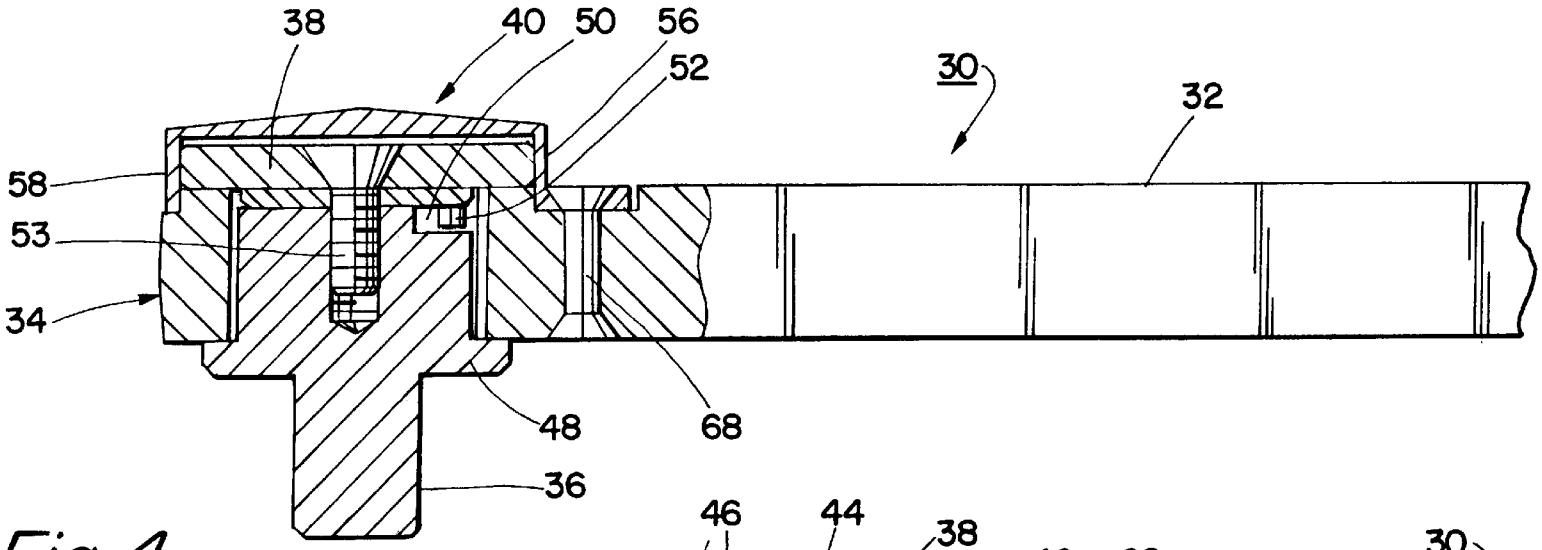
FIG. 4 is a partial left side elevational view, partially in section, of the driver of FIG. 2.

Referring now to FIG. 4, the driver 30 is shown in side elevation, with the head 34, drive stem 36, control wheel and cover plate 40 shown in section. A ratcheting mechanism 48 is shown for illustrative purposes as a solid element formed integrally with the drive stem 36, as the particular ratcheting mechanism forms no part of the present invention. Any one of the various conventional ratcheting mechanisms well known in the art which may be selected by those incorporating the present invention into a ratcheting driver is to be used. The only modification of such conventional ratcheting mechanisms incorporated in the preferred embodiment of the present invention illustrated in FIG. 4 is the provision of a recess 50 in the ratcheting mechanism 48 to receive an alignment lug 52 depending from the control wheel 38. The lug 52 and recess 50 are used to lock the control wheel 38, which is attached to the ratcheting mechanism 48 by a bolt 53 extending through a central aperture 70 in the control wheel 38 (see FIG. 7). However, the frictional engagement of the wheel 38 and ratcheting mechanism 48 provided by the bolt 52 may be relied upon, if desired, to maintain the fixed position of the wheel 38 with respect to the ratcheting mechanism 48, or any other suitable structure obviously may be used to accomplish this result.

Figure 5:
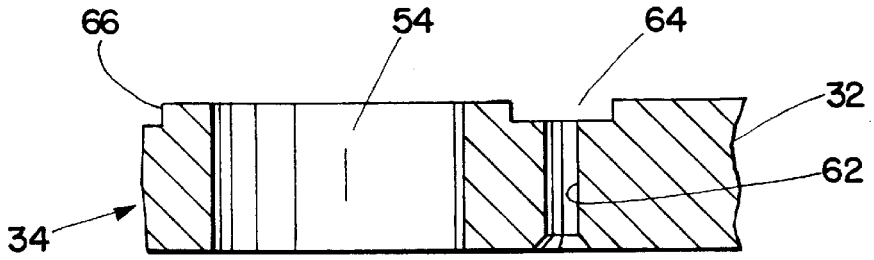
FIG. 5 is a partial left side elevational view, in section, of the head of the driver of FIG. 2, with the drive element, ratcheting mechanism, ratcheting direction control element, ratcheting direction control cover removed.

FIG. 5 is a side elevation, in cross section, of the head 34, illustrating the modifications of a conventional head, such as the head 14 (FIG. 1), required to incorporate the present invention in its preferred embodiment. The head 34 has a central bore 54 extending therethrough, as is conventional, for containing the ratcheting mechanism 48 and drive stem 36 in axial alignment with one another (see FIG. 4). As is shown in FIG. 4, the control wheel 38 and cover plate 40 are also axially aligned with the central bore 54 best seen in FIG. 5.

Figure 6:
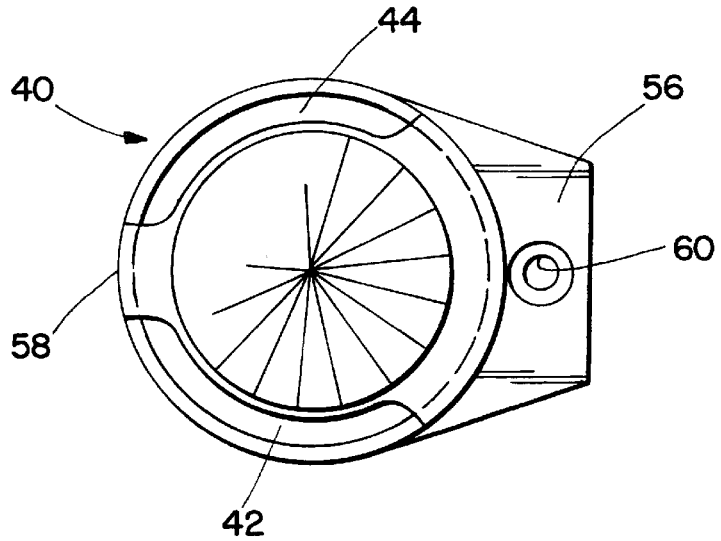
FIG. 6 is a plan view of the ratcheting direction control cover of the driver of FIG. 2.
Figure 7:
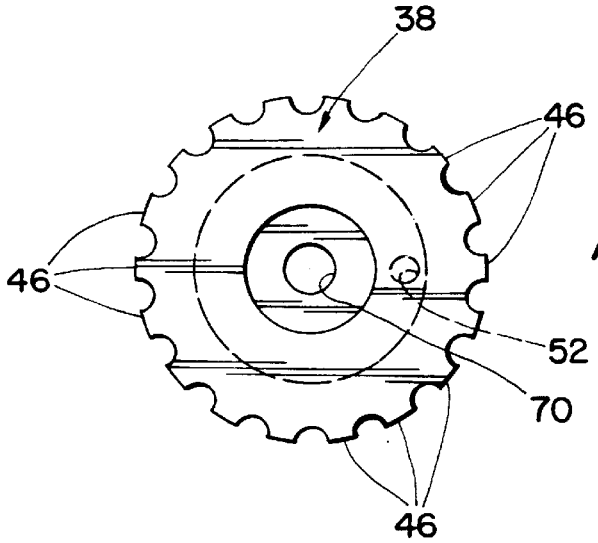
FIG. 7 is a plan view of the ratcheting direction control element of the driver of FIG. 2.

As is shown in FIGS. 4 and 6, the cover plate 40 has a depending tail element 56 at one end thereof, and a depending foot 58 at its opposite end. The tail element has an aperture 60, shown for illustrative purposes as countersunk, formed therein.

In FIG. 5, the head 34 is shown as modified from the conventional head 10 by an aperture 62 which opens onto a recess 64 adjacent the handle 32 and a step formed on the head 34 so that the bore 54 is disposed therebetween. As is seen in FIG. 4, the cover plate tail element 56 is received in the head recess 64, so that the tail element aperture 60 and the head aperture 62 are in longitudinal alignment and have a fastener fixing them together. The step 66 receives the cover plate depending foot 58, so as to hold the cover plate 40 above the torque direction control wheel 38.

In operation, the drive stem is inserted into the element to be driven in conventional fashion. The torque direction control wheel is rotated in the appropriate direction, if necessary, in order to enable torque in the desired direction to be applied to the element to be driven. The user applies torque to the handle with one hand and, if and as necessary, applies the other hand to the cover plate to exert a force on the driven element which is normal to the direction of rotation, in order to assist in the rotation of the driven element.

Although the presently preferred embodiment of the invention has been set forth herein in detail for illustrative purposes, it will be apparent to those skilled in the art that variations and modifications thereof, including the rearrangement of parts, lie within the scope of the present invention, which is not limited to the specific structures of the embodiments shown or described herein, but only by the scope of the following claims.

The invention claimed is:

1. In a ratcheting driver of the type having a handle, a driver head connected to the handle, a driver stem, ratchet means contained in the head and including ratcheting direction selector means disposed on the head in axial alignment with and remote from the driver stem and operable to lock the driver stem against rotation in a direction which is preselected by the user by the limited rotation of the ratcheting direction selector means in a predetermined direction, the improvement comprising:

the ratcheting direction control means including a ratcheting direction control wheel disposed on the head in axial alignment with and remote from the driver stem and fixed to the ratchet means, a control wheel cover disposed over the control wheel so as to be separated from the head thereby; and means for fixing the cover to the head so that the cover is locked thereto, and in which the means for fixing the cover to the head includes a tail element formed on the cover so as to extend toward the handle, an aperture formed in the tail element, a complementary aperture formed in the head, and a fastener extending through the apertures in the head and tail element.

2. The improvement of claim 1, and in which the cover is generally planar in cross section and in which the tail element depends therefrom, and in which the cover includes a foot element formed thereon so as to depend therefrom remote from the tail element, said foot elemept being operable to engage the head when the cover is fixed thereto.

3. In a ratcheting driver of the type having a handle, a driver head connected to the handle, a driver stem, ratchet means contained in the head and including ratcheting direction selector means disposed on the head in axial alignment with and remote from the driver stem and operable to lock the driver stem against rotation in a direction which is preselected by the user by the limited rotation of the ratcheting direction selector means in a predetermined direction, the improvement comprising:

the ratcheting direction selector means including a ratcheting direction control wheel disposed on the head in axial alignment with and remote from the driver stem and fixed to the ratchet means;

a control wheel cover disposed over the control wheel so as to be separated from the head thereby; and means for fixing the cover to the head so that the cover is locked thereto, and in which the means for fixing the cover to the head includes a tail element formed on the cover so as to extend toward the handle, an aperture formed in the tail element, a complementary aperture formed in the head, and a fastener extending through the apertures in the head and tail element, and the control wheel cover has at least one cut out formed in its perimeter so as to permit manual access to the control wheel.

4. The improvement of claim 3, and in which the cover is generally planar in cross section and in which the tail element depends therefrom, and in which the cover includes a foot elements formed thereon so as to depend therefrom remote from the tail element, said foot element being operable to engage the head when the cover is fixed thereto.

* * * * *